United States Patent [19]

Pangrazi et al.

[11] Patent Number: 5,011,712

[45] Date of Patent: Apr. 30, 1991

[54] FORMALDEHYDE-FREE HEAT RESISTANT BINDERS FOR NONWOVENS

[75] Inventors: Ronald Pangrazi, Flemington; James L. Walker, Whitehouse Station, both of N.J.

[73] Assignee: National Starch and Chemical Investment Holding Corporation, Wilmington, Del.

[21] Appl. No.: 324,071

[22] Filed: Mar. 16, 1989

[51] Int. Cl.[5] ..... B05D 3/02

[52] U.S. Cl. ..... 427/389.9; 428/240

[58] Field of Search ..... 428/290; 524/828, 831, 524/832, 833; 427/389.9

[56] References Cited

U.S. PATENT DOCUMENTS

| | | | |
|---|---|---|---|
| 4,443,623 | 4/1984 | Photis | 560/170 |
| 4,446,280 | 5/1984 | Cady et al. | 525/186 |
| 4,454,301 | 6/1984 | Cady et al. | 525/118 |
| 4,554,337 | 11/1985 | Krinski et al. | 527/201 |

OTHER PUBLICATIONS

American Cyanamid Company Technical Bulletin, MAGME Multi-Functional Acrylic Monomer, pp. 1-23.

Effect of Alpha-Methyl Groups on Room Temperature Crosslinking in Acrylic Polymer Containing MAGME Monomers by Howard R. Lucas, pp. 49-55.

American Cyanamid Company Technical Bulletin, Methyl Acrylamidoglycolate Methyl Ether.

*Primary Examiner*—James J. Bell

*Attorney, Agent, or Firm*—Edwin M. Szala; Ellen T. Dec

[57] ABSTRACT

Formaldehyde-free heat resistant binders for flexible nonwoven products may be prepared using an emulsion polymer comprising 100 parts by weight of $C_1$-$C_4$ alkyl acrylate or methacrylate or styrene/acrylate ester monomers, 0.5 to 5 parts of a hydroxyalkyl acrylate or methacrylate, 3 to 6 parts of methyl acrylamido glycolate methyl ether and 0.1 to 5 parts of a multifunctional comonomer. The binders are useful in the formation of heat resistant flexible products for use in roofing, flooring and filtering materials.

16 Claims, No Drawings

FORMALDEHYDE-FREE HEAT RESISTANT BINDERS FOR NONWOVENS

BACKGROUND OF THE INVENTION

The present invention is directed to formaldehyde-free binders for use in the formation of nonwoven products to be utilized in areas where heat resistance is important. Such products find use in a variety of applications including in roofing, flooring and filtering materials.

Specifically, in the formation of asphalt-like roofing membranes or the like, such as those used on flat roofs, polyester webs or mats about one meter in width are formed, saturated with binder, dried and cured to provide dimensional stability and integrity to the webs allowing them to be used on site or rolled and transported to a converting operation where one or both sides of the webs are coated with molten asphalt. The binder utilized in these webs plays a number of important roles in this regard. If the binder composition does not have adequate heat resistance, the polyester web will shrink when coated at temperatures of 150°-250° C. with the asphalt. A heat resistant binder is also needed for application of the roofing when molten asphalt is again used to form the seams and, later, to prevent the roofing from shrinking when exposed to elevated temperatures over extended periods of time. Such shrinking would result in gaps or exposed areas at the seams where the roofing sheets are joined as well as at the perimeter of the roof.

Since the binders used in these structures are present in substantial amounts, i.e., on the order of about 25% by weight, the physical properties thereof must be taken into account when formulating for improved heat resistance. Thus, the binder must be stiff enough to withstand the elevated temperatures but must also be flexible at room temperature so that the mat may be rolled or wound without cracking or creating other weaknesses which could lead to leaks during and after impregnation with asphalt.

Binders for use on such nonwoven products have conventionally been prepared from acrylate or styrene/acrylate copolymers containing N-methylol functionality. In this case, the curing of the emulsion polymer is effected via crosslinking with the methylol groups and subsequent release of formaldehyde. Because of the inherent problems of the toxicity and potential health effects encountered during exposure to even small amounts of formaldehyde, there exists a real need for alternatives to formaldehyde-based crosslinking systems.

SUMMARY OF THE INVENTION

Formaldehyde-free heat resistant binders for flexible polyester webs may be prepared using an emulsion polymer having a glass transition temperature (Tg) of ±10° to ±50° C.; the polymer comprising 100 parts by weight of acrylate or styrene/acrylate monomers, 0.5 to 5 parts of a hydroxyalkyl acrylate or methacrylate; 3 to 6 parts of methyl acrylamido glycolate methyl ether; and 0.1 to 3 parts of a multifunctional comonomer.

These binders are not only formaldehyde free but also exhibit an exceptionally high degree of heat resistance and, as such, are useful in the formation of heat resistant flexible webs or mats for use in roofing, flooring and filtering materials.

DETAILED DESCRIPTION OF THE PREFERRED EMBODIMENTS

The acrylate or styrene/acrylate monomers comprise the major portion of the emulsion copolymer and should be selected to have a Tg within the range of +10° to +50° C., preferably about 20° to 40° C. The acrylate esters used in the copolymers described herein the alkyl acrylates or ethylenically unsaturated esters of acrylic or methacrylic acid containing 1 to 4 carbon atoms in the alkyl group including methyl, ethyl, propyl and butyl acrylate. The corresponding methacrylate esters may also be used as may mixtures of any of the above. Suitable copolymers within this Tg range may be prepared, for example, from copolymers of styrene with $C_2$-$C_4$ acrylates or methacrylate and from copolymers of $C_2$-$C_4$ acrylates or methacrylate with methyl methacrylate or other higher Tg methacrylates. The relative proportions of the comonomers will vary depending upon the specific acrylate(s) employed. Thus relatively soft, low Tg acrylates are used in lesser amounts to soften the harder styrene comonomer or stiff methacrylate comonomer while larger amounts of the harder, higher Tg acrylates are required to achieve the same Tg range. It will also be recognized that other comonomers, which are sometimes used in emulsion binders and which do not generate formaldehyde on curing, may also be present in conventional amounts and at levels consistant with the desired Tg range.

In addition to 3 to 6 parts, preferably 2 to 5 parts, methyl acrylamido glycolate methyl ether, there is present in the binders of the invention 0.1 to 3 parts by weight, preferably 0.3 to 1.5 parts, of a multifunctional comonomer. These multifunctional monomers provide some crosslinking and consequent heat resistance to the binder prior to the ultimate heat activated curing mechanism. Suitable multifunctional monomers include vinyl crotonate, allyl acrylate, allyl methacrylate, diallyl maleate, divinyl adipate, diallyl adipate, divinyl benzene, diallyl phthalate, ethylene glycol diacrylate, ethylene glycol dimethacrylate, butanediol dimethacrylate, methylene bis-acrylamide, triallyl cyanurate, trimethylolpropane triacrylate, etc. with triallyl cyanurate preferred. The amount of the multi-functional monomer required to obtain the desired level of heat resistance will vary within the ranges listed above. In particular, we have found that when triallyl cyanurate is employed superior heat resistance can be obtained at levels as low as about 0.1 to 1 parts, preferably about 0.5 while higher amounts of other multi-functional monomers are needed for comparable results.

The hydroxy functional monomers utilized herein include the hydroxy $C_2$-$C_4$ alkyl acrylates or methacrylates such as hydroxyethyl, hydroxypropyl and hydroxybutyl acrylate or methacrylate. These comonomers are used in amounts of 0.5 to 3 parts, preferably 1 to 3 parts, more preferably about 2 parts by weight per 100 parts acrylate monomer.

Olefinically unsaturated acids may also be employed to improve adhesion to the polyester web and contribute some additional heat resistance. These acids include the alkenoic acids having from 3 to 6 carbon atoms, such as acrylic acid, methacrylic acid, crotonic acid; alkenedioic acids, e.g., itaconic acid, maleic acid or fumaric acid or mixtures thereof in amounts sufficient to provide up to about 4 parts, preferably 0.5 to 2.5 parts, by weight of monomer units per 100 parts of the acrylate monomers.

These binders are prepared using conventional emulsion polymerization procedures. In general, the respective comonomers are interpolymerized in an aqueous medium in the presence of a catalyst, and an emulsion stabilizing amount of an anionic or a nonionic surfactant or mixtures thereof, the aqueous system being maintained by a suitable buffering agent, if necessary, at a pH of 2 to 6. The polymerization is performed at conventional temperatures from about 20° to 90° C., preferably from 50° to 80° C., for sufficient time to achieve a low monomer content, e.g. from 1 to about 8 hours, preferably from 3 to about 7 hours, to produce a latex having less than 1.5 percent preferably less than 0.5 weight percent free monomer. Conventional batch, semi-continuous or continuous polymerization procedures may be employed.

The polymerization is initiated by a water soluble free radical initiator such as water soluble peracid or salt thereof, e.g. hydrogen peroxide, sodium peroxide, lithium peroxide, peracetic acid, persulfuric acid or the ammonium and alkali metal salts thereof, e.g. ammonium persulfate, sodium peracetate, lithium persulfate, potassium persulfate, sodium persulfate, etc. A suitable concentration of the initiator is from 0.05 to 3.0 weight percent and preferably from 0.1 to 1 weight percent.

The free radical initiator can be used alone and thermally decomposed to release the free radical initiating species or can be used in combination with a suitable reducing agent in a redox couple. The reducing agent is typically an oxidizable sulfur compound such as an alkali metal metabisulfite and pyrosulfite, e.g. sodium metabisulfite, sodium formaldehyde sulfoxylate, potassium metabisulfite, sodium pyrosulfite, etc. The amount of reducing agent which can be employed throughout the copolymerization generally varies from about 0.1 to 3 weight percent of the amount of polymer.

The emulsifying agent can be of any of the nonionic or anionic oil-in-water surface active agents or mixtures thereof generally employed in emulsion polymerization procedures. When combinations of emulsifying agents are used, it is advantageous to use a relatively hydrophobic emulsifying agent in combination with a relatively hydrophobic agent. The amount of emulsifying agent is generally from about 1 to about 10, preferably from about 2 to about 6, weight percent of the monomers used in the polymerization.

The emulsifier used in the polymerization can also be added, in its entirety, to the initial charge to the polymerization zone or a portion of the emulsifier, e.g. from 90 to 25 percent thereof, can be added continuously or intermittently during polymerization.

The preferred interpolymerization procedure is a modified batch process wherein the major amounts of some or all the comonomers and emulsifier are added to the reaction vessel after polymerization has been initiated. In this matter, control over the copolymerization of monomers having widely varied degrees of reactivity can be achieved. It is preferred to add a small portion of the monomers initially and then add the remainder of the major monomers and other comonomers intermittently or continuously over the polymerization period which can be from 0.5 to about 10 hours, preferably from about 2 to about 6 hours.

The latices are produced and used at relatively high solids contents, e.g. up to about 60%, although they may be diluted with water if desired. The preferred latices will contain about from 45 to 55, and, most preferred about 50% weight percent solids.

In utilizing the binders of the present invention, the polyester fibers are collected as a web or mat using spun bonded, needle punched, entangled fiber, card and bond or other conventional techniques for nonwoven manufacture. When used for roofing membranes, the resultant mat preferably ranges in weight from 10 grams to 300 grams per square meter with 100 to 200 grams being more preferred and 125 to 175 considered optimal. The mat is then soaked in an excess of binder emulsion to insure complete coating of fibers with the excess binder removed under vacuum or pressure of nip/print roll. The polyester mat is then dried and the binder composition cured preferably in an oven at elevated temperatures of at least about 150° C. Alternatively, catalytic curing may be used, such as with an acid catalyst, including mineral acids such as hydrochloric acid; organic acids such as oxalic acid or acid salts such as ammonium chloride, as known in the art. The amount of catalyst is generally about 0.5 to 2 parts by weight per 100 parts of the acrylate based polymer.

Other additives commonly used in the production of binders for these nonwoven mats may optionally be used herein. Such additives include ionic crosslinking agents, theremosetting resins, thickeners, flame retardants and the like.

While the discussion above has been primarily directed to polyester mats for use as roofing membranes, the binders of the invention are equally applicable in the production of other nonwoven products including polyester, felt or rayon mats to be used as a backing for vinyl flooring where the vinyl is applied at high temperatures and under pressure so that some heat resistance in the binder is required. Similarly, cellulosic wood pulp filters for filtering hot liquids and gases require heat resistant binders such as are disclosed herein.

The following examples are given to illustrate the present invention, but it will be understood that they are intended to be illustrative only and not limitative of the invention. In the examples, all parts are by weight and all temperatures in degrees Celsius unless otherwise noted.

EXAMPLE I

The following example describes a method for the preparation of the latex binders of the present invention.

To a 5 liter stainless steel reaction vessel was charged: 1025 g water, 2.5 g Aerosol A102 a surfactant from American Cyanamid, 6.3 g Triton X-405 a surfactant from Rohm & Haas, 0.8 g sodium acetate, and 1.75 g ammonium persulfate.

After closing the reactor, the charge was purged with nitrogen and evacuated to a vacuum of 25–37 inches mercury. Then 65 g of ethyl acrylate monomer was added.

The reaction was heated to 65° to 75° C. and after polymerization started, the remainder of the monomer and functional comonomer was added. An emulsified monomer mix consisting of 175 g water, 110 g of AER A102, 62.5 g of methyl acrylamido glycolate methyl ether, 25 g of hydroxypropyl methacrylate, 12.5 g methacrylic acid, 6.0 g of triallylcyanurate, 685 g ethyl acrylate and 500 g methyl methacrylate was prepared as was a solution of 3.0 g ammonium persulfate and 1.6 g 28% $NH_4OH$ in 150 g of water. The emulsified monomer mix and initiator solutions were added uniformly over four (4) hours with the reaction temperature being maintained at 75° C. At the end of the addition, the reaction was held 1 hour at 75° C., then 1.25 g of t-butyl hydroperoxide and 1.25 g sodium formaldehyde sulfoxylate in 15 g of water was added to reduce residual monomer.

The latex was then cooled and filtered. It had the following typical properties: 49.5% solids, pH 3.7, 0.18 micron average particle size and 45 cps viscosity.

The resultant binder, designated in Table I as Emulsion 1, had a composition of 60 parts ethyl acrylate, 40 parts methyl methacrylate, 5 parts methyl acrylamido glycolate methyl ether, 2.0 parts hydroxypropyl methacrylate, 1 part acrylic acid and 0.5 part triallyl cyanurate (60 EA/40 MMA/5 MAGME/1AA/2HPMA/0.5 TAC) as a base.

Using a similar procedure the other emulsions described in Table I were prepared using 100 parts of a 60/40 ethyl acrylate/methyl methacrylate ratio of monomers.

In testing the binders prepared herein, a polyester spunbonded, needlepunched mat was saturated in a low solids (10–30%) emulsion bath. Excess emulsion was removed by passing the saturated mat through nip rolls to give samples containing 25% binder on the weight of the polyester. The saturated mat was dried on a canvas covered dried then cured in a forced air oven for 10 minutes at a temperature of 150° C. Strips were then cut 2.54 cm by 12.7 cm in machine direction. Tensile values were measured on an Instron tensile tester Model 1130 equipped with an environmental chamber at crosshead speed 10 cm/min. The gauge length at the start of each test was 7.5 cm.

In order to evaluate the heat resistance of the binders prepared herein, a Thermomechanical Analyzer was employed to show a correlation between conventional tensile and elongation evaluations.

The Thermomechanical Analyzer measures dimensional changes in a sample as a function of temperature. In general, the heat resistance is measured by physical dimensional changes of a polymer film as a function of temperature which is then recorded in a chart with temperature along the absicissa and change in linear dimension as the ordinate. Higher dimensional change in the samples represents lower heat resistance. The initial inflection is interpreted as the thermomechanical glass transition temperature (Tg) of the polymer. Samples were prepared for testing on the Analyzer by casting films of the binders on Teflon coated metal plates with a 20 mil. applicator. The dimensional changes in millimeters at two specific intervals, were recorded and are presented as Delta L Extension at 100° C. and 200° C. in Table I.

TABLE

| Emulsion | Polymer Composition MAGME | HPMA | MAA | TAC | Delta L Extension 100° C. | 200° C. |
|---|---|---|---|---|---|---|
| 1 | 5 | 2 | 1 | 0.5 | 0.303 | 0.887 |
| 2 | 3 | 5 | 1 | 0.5 | 0.577 | 1.036 |
| 3 | 6 | 3 | 1 | 0.5 | 0.297 | 0.759 |
| 4 | 6 | 3 | 1 | 1.0 | 0.291 | 0.722 |
| 5 | 6 | 5 | 1 | 0.5 | 0.249 | 0.629 |
| Control | * | * | * | * | 0.30 | 0.55 |

*Control = Commercially available and acceptable acrylic resin containing, among other unidentified comonomers, approximately 5.5 parts N-methylol functionality.
MAGME = Methyl acrylamide glycolate methyl ether
HPMA = Hydroxypropyl methacrylate
MAA = Methacrylic acid
TAC = Triallyl cyanurate

EXAMPLE II

Using the procedure described in Example I, similar formaldehyde-free heat resistant binders can be prepared using 100 parts of a 60/40 ethyl acrylate/methyl methacrylate copolymer with the comonomers listed in Table II.

TABLE II

| MAGME | HPMA | HEMA | HPA | HEA | MAA | AA | TAC | TMPTA |
|---|---|---|---|---|---|---|---|---|
| 5 | 2 | — | — | — | 0 | — | 0.5 | — |
| 3 | 2 | — | — | — | 1 | — | 0.5 | — |
| 6 | 5 | — | — | — | 1 | — | 1.0 | — |
| 6 | 3 | — | — | — | 0 | — | 0.5 | — |
| 5 | — | 3.5 | — | — | 1.5 | — | — | 1 |
| 5 | — | — | 4 | — | — | 1 | — | 1 |
| 5 | — | — | — | 3 | — | 2 | — | 1 |

MAGME = Methyl acrylamide glycolate methyl ether
HPMA = Hydroxypropyl methacrylate
MAA = Methacrylic acid
TAC = Triallyl cyanurate
HEMA = Hydroxyethyl methacrylate
HPA = Hydroxypropyl acrylate
HEA = Hydroxyethyl acrylate
AA = Acrylic acid
TMPTA = Trimethylol propane triacrylate The heat-resistant properties achieved using any of the resultant binders will provide Delta L values comparable to those presented in Table I.

As the above results show, superior heat resistance properties can be obtaining utilizing the formaldehyde-free emulsion binders described herein. Moreover, comparable commercially acceptable results will be obtained using various other copolymeric compositions disclosed herein above including polymers prepared based on styrene/acrylate copolymers, other hydroxy functional monomers such as hydroxyethyl, hydroxypropyl or hydroxybutyl acrylate or methacrylate or other multifunctional monomers such as vinyl crotonate, allyl acrylate, allyl methacrylate, diallyl maleate, divinyl adipate, diallyl adipate, divinyl benzene, diallyl phthalate, ethylene glycol diacrylate, ethylene glycol dimethacrylate, butanediol dimethacrylate, methylene bis-acrylamide, triallyl cyanurate, trimethylolpropane triacrylate, etc.

It is apparent that various changes and modifications may be made in the embodiments of the invention described above, without departing from the scope of the invention, as defined in the appended claims, and it is intended therefore, that all matter obtained in the foregoing description shall be interpreted as illustrative only and not as limitative of the invention.

We claim:

1. In a process for preparing a heat resistant nonwoven product comprising the steps of:

(a) impregnating a nonwoven web with an aqueous binder;

(b) removing excess binder;

(c) drying and curing the mat;

the improvement which comprises utilizing as the binder an emulsion polymer having a glass transition temperature (Tg) of +10° to +50° C., said polymer consisting essentially of 100 parts by weight of $C_1$–$C_4$ alkyl acrylate or methacrylate ester monomers or mixtures thereof or styrene/acrylate monomers, 0.5 to 5 parts of a hydroxyalkyl acrylate or methacrylate, 3 to 6 parts of methyl acrylamido glycolate methyl ether; and 0.1 to 3 parts of a multifunctional comonomer.

2. The process of claim 1 wherein the web is cured by heating at a temperature of at least about 150° C.

3. The process of claim 1 wherein the web is cured by catalysis.

4. The process of claim 1 wherein the emulsion polymer contains as a major constituent monomers of ethyl acrylate and methyl methacrylate.

5. The process of claim 1 wherein the hydroxyalkyl acrylate comonomer in the emulsion polymer is present in an amount of 1 to 3 parts by weight.

6. The process of claim 1 wherein the hydroxyalkyl acrylate comonomer in the emulsion polymer is selected from the group consisting of hydroxyethyl, hydroxypropyl and hydroxybutyl acrylate or methacrylate.

7. The process of claim 1 wherein the methyl acrylamido glycolate methyl ether is present in an amount of 2 to 5 parts by weight.

8. The process of claim 1 wherein the multifunctional comonomer in the emulsion polymer is selected from the group consisting of vinyl crotonate, allyl acrylate, allyl methacrylate, diallyl maleate, divinyl adipate, diallyl adipate, divinyl benzene, diallyl phthalate, ethylene glycol diacrylate, ethylene glycol dimethacrylate, butanediol dimethacrylate, methylene bis-acrylamide, triallyl cyanurate, trimethylolpropanetriacrylate.

9. The process of claim 8 wherein the multifunctional comonomer is triallyl cyanurate.

10. The process of claim 1 wherein there is additionally present in the emulsion polymer up to 4 parts by weight of an alkenoic or alkenedioic acid having from 3 to 6 carbon atoms.

11. The process of claim 1 wherein the nonwoven web is selected from the group consisting of polyester, felt, rayon or cellulose wood pulp.

12. The process of claim 11 wherein the nonwoven web is polyester.

13. In a process for preparing a heat resistant nonwoven product comprising the steps of:

(a) impregnating a nonwoven web with an aqueous binder;

(b) removing excess binder;

(c) drying and curing the mat;

the improvement which comprises utilizing as the binder an emulsion polymer having a glass transition temperature (Tg) of +10° to 50° C., said polymer consisting essentially of 100 parts by weight of $C_1$–$C_4$ acrylate or methacrylate ester monomers or mixtures thereof or styrene/acrylate monomers, 0.5 to 5 parts of a hydroxyalkyl acrylate or methacrylate, 4 to 6 parts of methyl acrylamido glycolate methyl ether; and 0.1 to 1 part of triallyl cyanurate.

14. The process of claim 13 wherein the emulsion polymer contains as a major constituent monomers of ethyl acrylate and methyl methacrylate.

15. The process of claim 13 wherein the methyl acrylamido glycolate methyl ether is present in an amount of 2 to 5 parts by weight.

16. The process of claim 13 wherein there is additionally present in the emulsion polymer up to 4 parts by weight of an alkenoic or alkenedioic acid having from 3 to 6 carbon atoms.

* * * * *